US007824080B2

(12) United States Patent
Gibson et al.

(10) Patent No.: US 7,824,080 B2
(45) Date of Patent: Nov. 2, 2010

(54) HOUSING FOR A RECESSED LIGHT FIXTURE

(75) Inventors: Jeffrey Lee Gibson, Florence, AL (US); Doug Miles, Fayetteville, GA (US)

(73) Assignee: Cooper Technologies Company, Houston, TX (US)

( * ) Notice: Subject to any disclaimer, the term of this patent is extended or adjusted under 35 U.S.C. 154(b) by 166 days.

(21) Appl. No.: 11/939,299

(22) Filed: Nov. 13, 2007

(65) Prior Publication Data

US 2008/0180961 A1 Jul. 31, 2008

Related U.S. Application Data

(60) Provisional application No. 60/865,509, filed on Nov. 13, 2006.

(51) Int. Cl.
*F21V 15/00* (2006.01)
*F21S 8/00* (2006.01)

(52) U.S. Cl. ..... 362/364; 362/147

(58) Field of Classification Search ..... 362/364, 362/362, 373, 145, 147, 148
See application file for complete search history.

(56) References Cited

U.S. PATENT DOCUMENTS 3,040,172 A * 6/1962 Chan ..... 362/257
4,510,559 A * 4/1985 Kristofek ..... 362/269
4,703,406 A * 10/1987 Elliott et al. ..... 362/365
4,751,624 A * 6/1988 Russo et al. ..... 362/276
4,930,054 A * 5/1990 Krebs ..... 362/149
5,457,617 A * 10/1995 Chan et al. ..... 362/366
5,548,499 A * 8/1996 Zadeh ..... 362/366
6,105,334 A * 8/2000 Monson et al. ..... 52/741.3
6,123,438 A * 9/2000 Hentz ..... 362/373
6,176,599 B1 * 1/2001 Farzen ..... 362/365
6,286,980 B1 * 9/2001 Meyer ..... 362/365
6,364,511 B1 * 4/2002 Cohen ..... 362/368
6,632,006 B1 * 10/2003 Rippel et al. ..... 362/366
6,719,438 B2 * 4/2004 Sevack et al. ..... 362/147
7,320,536 B2 * 1/2008 Petrakis et al. ..... 362/364
2007/0019418 A1 * 1/2007 Czech et al. ..... 362/364

* cited by examiner

*Primary Examiner*—Jon-Suk (James) Lee
*Assistant Examiner*—David R Crowe
(74) *Attorney, Agent, or Firm*—King & Spalding LLP

(57) ABSTRACT

The housing for a light fixture includes a plaster frame with an opening. The can light, having opened ends along the top and bottom, is positioned through the opening. A trim assembly and lamp assembly are connected to the bottom side of the can. An outer housing, having dimensions suitable for placing the housing between joists having sixteen inch centers, is connect to the plaster frame and about the top portion of the can. The outer housing includes a doubler panel positioned within the inner walls of the outer housing and having a geometry and size to match with and fit snugly into the upper portion of the outer housing. The open can allows for convection to draw the heat away from the lamp assembly and into the outer housing. The doubler panel evenly distributes the heat along the exterior surfaces of the housing.

23 Claims, 3 Drawing Sheets

HOUSING FOR A RECESSED LIGHT FIXTURE

RELATED PATENT APPLICATION

This patent application claims priority under 35 U.S.C. §119 to U.S. Provisional Patent Application No. 60/865,509, entitled "Halo Lighting Fixture," filed Nov. 13, 2006, the complete disclosure of which is hereby fully incorporated herein by reference.

TECHNICAL FIELD

The invention relates generally to recessed lighting fixtures and more particularly to a insulation contact housings for a recessed lighting fixture.

BACKGROUND

A recessed lighting fixture is a light fixture that is installed in a hollow opening in a ceiling. A typical recessed lighting fixture includes hanger bars fastened to spaced-apart ceiling supports or joists. A plaster frame extends between the hanger bars and includes an aperture configured to receive a lamp housing or "can." A bottom edge of an installed can should be flush with a bottom edge of the ceiling. Thus, the bottom of the installed lighting fixture is mounted flush with the visible surface of the ceiling, and the body of the lighting fixture projects into the space above the ceiling.

Because these recessed fixtures are in contact with, or very close to, the ceiling and joists the temperature of the portions of the fixture that will come into contact with any flammable materials must be maintained below acceptable levels. Standards have been created that set forth the acceptable temperature levels for different portions of the recessed fixture. Typically, those portions of the recessed fixture in contact with or very close to the ceiling or joists must maintain a temperature at those contact points that is below ninety degrees Celsius. For recessed lighting fixtures that will come into contact with insulation, called insulation contact or "IC" fixtures, the portions of the fixture that are in contact with the insulation also must be maintained below these acceptable temperature levels. Furthermore, for IC recessed fixtures, the can cannot directly vent thermal energy into the area above the ceiling.

Conventional fixtures have included many methods to distribute thermal energy to prevent the recessed fixture from having a temperature above acceptable levels. For instance, some conventional recessed fixtures have a can that is "closed" at the top and open at the bottom to direct the thermal energy downward below the ceiling and into the room environment. Other conventional recessed fixtures improved on this by placing a domed top on the can to increase the surface area of the can for the dispersion of thermal energy that is not directed down and out of the can. Unfortunately, for many lamps having higher wattage output (and therefore higher levels of thermal energy) a closed can is not able to adequately disperse the thermal energy and maintain a temperature below the acceptable level, especially at the top of the can and along the trim where it contacts the ceiling.

To overcome this problem, some conventional recessed fixtures replaced the closed can with an "open" can, having openings at both the top and the bottom of the can. Furthermore, since the thermal energy could not be directly vented into the ceiling, an air-tight housing was placed around the portion of the can above the ceiling level. While the open can recessed fixture provided improved thermal characteristics, by drawing the thermal energy up through the can and into the housing through convection and radiation, for higher wattage lamps, the top of the housing typically reached temperature levels that were still above the acceptable level because an inordinate amount of thermal energy was directly transmitted to the top of the housing through convection in the open can. Conventional methods for solving this problem include making the housing big enough such that it has sufficient surface area to distribute the heat and maintain the exterior surfaces below the acceptable levels. However, larger housings take up larger spaces in the ceiling area, are bulkier to install and are generally not favored. Furthermore, in many residential applications, one or more dimensions of the housing are restricted based on the distance between the joists or the distance between the ceiling and the roof structure.

Therefore, a need exists in the art for recessed lighting fixtures using higher wattage lamps to safely and efficiently distribute thermal energy and maintain exterior surfaces below acceptable levels. In particular, a need exists in the art for cost-efficient systems and methods for providing IC recessed lighting fixtures capable of efficiently distributing thermal energy while maintaining exterior surfaces of the fixture below acceptable levels in a housing having a relatively small volume.

SUMMARY

The invention provides an apparatus and system for efficiently distributing thermal energy in an IC recessed lighting fixture having a high watt lamp and a standard-sized housing. In certain aspects of the invention, the recessed light fixture can include a plate-shaped plaster frame. The plaster frame can include a hole extending through the plate of the plaster frame. A portion of a can light can be slidably inserted through the hole in the plate of the plaster frame. The can light can include openings along the top and bottom of the can that come together and define a channel or passageway through the can. A lamp can be positioned within the can for providing illumination. A housing can be placed along the plaster frame and around a portion of the can that extends up through the hole in the plate of the plaster frame. The housing can include wall members extending upward from the plaster frame and a ceiling member coupled to the upper portion of the wall members. The housing can also including a second plate that is placed between the ceiling of the housing and the plate of the plaster frame and is positioned within the housing.

In an alternative aspect of the invention, the recessed light fixture can include a horizontal bottom panel for the plaster frame. The bottom panel can include a hole extending vertically through the bottom panel of the plaster frame. An open-ended can may be dimension so that at least a portion of the can fits through the hole in the bottom panel of the plaster frame. The open-ended can may include openings along the top and bottom of the can, an outer wall, and a hollow core that extends from the top to the bottom opening and defines a channel or passageway through the can. A lamp assembly can include a fifty watt lamp and can be positioned within the can for providing illumination for an area near the fixture. A housing can be placed along and coupled to the bottom panel of the plaster frame and around a portion of the can that extends up through the hole in the bottom panel of the plaster frame. The housing can include several wall panels that extend upward from the bottom panel of the plaster frame and a second horizontal panel that is attached to the wall panels along the upper portion of each wall panel. The housing can also include a heat deflection panel positioned within the housing and above the top opening of the can between the bottom panel and the second horizontal panel. The heat deflection panel can be placed in a spaced-apart orientation in relation to the second horizontal panel.

In certain other aspects of the invention, the recessed light fixture can include a first horizontal panel acting as a bottom panel for the plaster frame. The bottom panel can include a hole extending vertically through a portion of the first horizontal panel. An open-ended can may be cylindrically shaped and coupled to the first horizontal panel. The can may be positioned such that a portion of the can extends though the hole in the first horizontal panel and a second portion extends below the first horizontal panel. The can may also be dimension so that at least a portion of the can fits through the hole in the first horizontal panel. The open-ended can includes openings along the top and bottom of the can, an outer wall and a hollow core that extends from the top to the bottom opening and defines a channel or passageway through the can. The opening along the bottom of the can may be three inches in diameter. A lamp assembly can include a fifty watt lamp and can be positioned within the channel of the can. A housing can be placed along and coupled to the first horizontal panel of the plaster frame and around a portion of the can that extends up through the hole in the first horizontal panel of the plaster frame. The housing can include a substantially horizontal ceiling panel and several wall panels that extend downward from and are coupled to the ceiling panel along the upper portion of each wall panel. The housing can also include a heat deflection panel positioned within the housing and above the top opening of the can between the bottom panel and the second horizontal panel. The heat deflection panel can be placed in a spaced-apart orientation in relation to the second horizontal panel. The fixture can also include a trim assembly that is coupled to the can. The trim assembly can include a portion that is placed adjacent to a bottom lip of the can and a gasket can be placed between the trim assembly and the bottom lip of the can to prevent light and heat loss.

These and other aspects, objects, features, and advantages of the invention will become apparent to a person of ordinary skill in the art upon consideration of the following detailed description of illustrated exemplary embodiments, which include the best mode of carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying figures in which.

DETAILED DESCRIPTION OF EXEMPLARY EMBODIMENTS

The present invention is directed to space-saving and cost-efficient systems and methods for providing a recessed housing for use with a recessed lighting fixture in an insulation contact ("IC") installation environment. In particular, the invention is directed to an improved recessed housing having a smaller profile for use with a fifty watt lamp fixture.

Turning now to the drawings, in which like numerals indicate like elements throughout the figures, exemplary embodiments of the present invention are described in detail.

Figure 1:
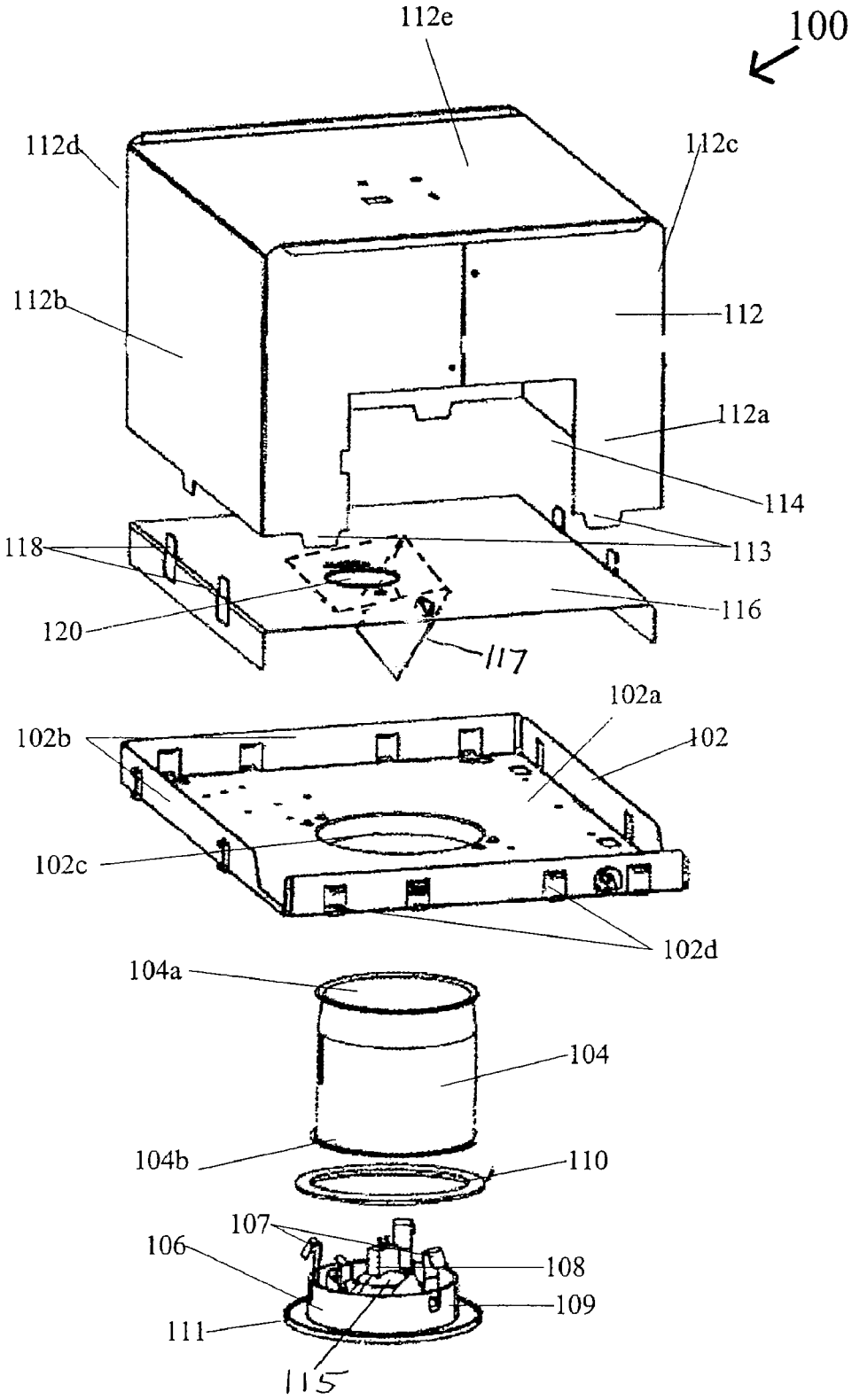
FIG. 1 is a perspective, exploded view of components of a recessed light fixture housing, according to certain exemplary embodiments.
Figure 2:
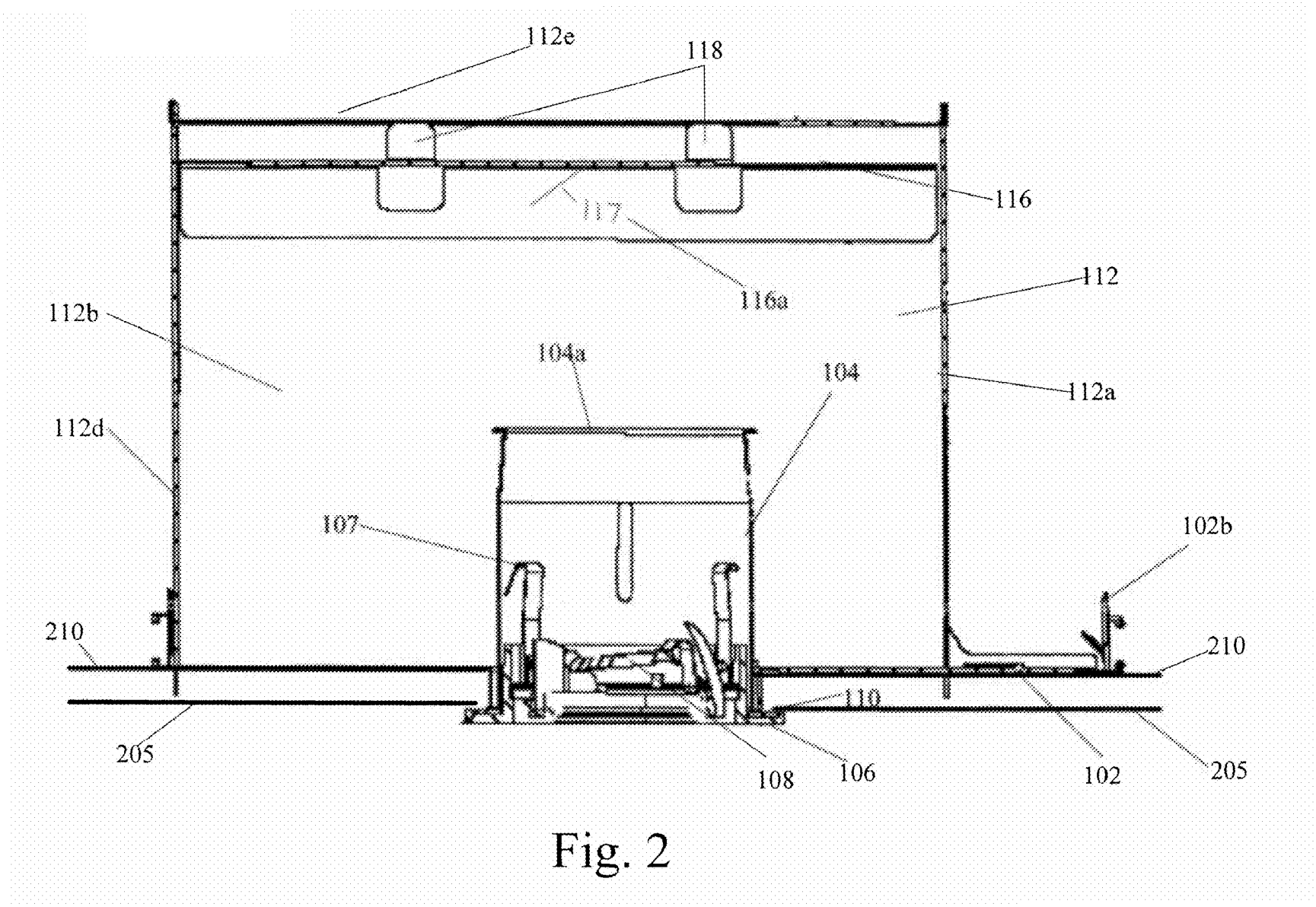
FIG. 2 is a cross-sectional side view of the recessed light fixture housing, according to certain exemplary embodiments.
Figure 3:
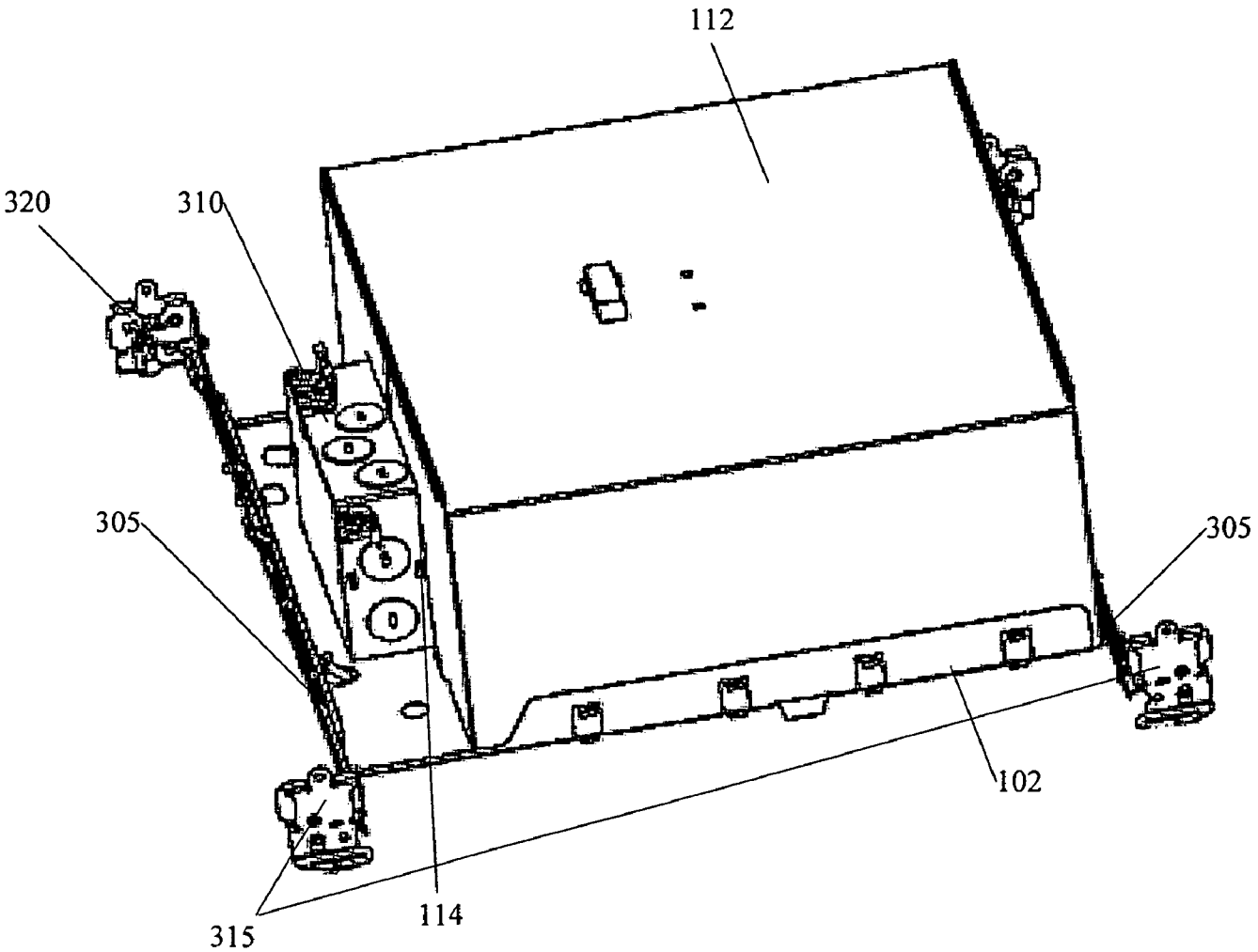
FIG. 3 is a perspective top view of the recessed light fixture housing, according to certain exemplary embodiments.

FIG. 1 is a perspective, exploded view of a plaster frame 102, an open-ended can 104, a trim assembly 106, a lamp assembly 108, a gasket 110, an outer housing 112 and a doubler panel 116 of a recessed light fixture housing 100, according to certain exemplary embodiments. FIG. 2 is a cross-sectional, side view of the assembled plaster frame 102, open-ended can 104, trim assembly 106, lamp assembly 108, gasket 110, outer housing 112, and doubler panel 116 of FIG. 1, according to certain exemplary embodiments. FIG. 3 is a perspective top view of the plaster frame 102, outer housing 112, a pair of hanger bars 305 and a junction box 310, according to certain exemplary embodiments.

With reference to FIGS. 1-3, the hanger bars 305 are configured to be mounted between spaced supports or joists (not shown) within a ceiling 205, 210. For example, each end 315, 320 of the hanger bars 305 can be fastened to vertical faces of the supports or joists by nailing or other fastening means, including but not limited to screws or spikes integral with the end 315, 320 of the hanger bar. In certain exemplary embodiments, each end 315, 320 of the hanger bar 305 can include integral fasteners for attaching the hanger bar 305 to the supports or joists, substantially as described in co-pending U.S. patent application Ser. No. 10/090,654, entitled "Hanger Bar for Recessed Luminaires with Integral Nail," the complete disclosure of which is hereby fully incorporated herein by reference.

The distance between supports or joists can vary to a considerable degree. Therefore, in certain exemplary embodiments, the length of each hanger bar 305 is adjustable. Each hanger bar 305 includes two inter-fitting members that are configured to slide adjacent to one another to provide a desired length of the hanger bar 305. A person of ordinary skill in the art having the benefit of the present disclosure will recognize that many other suitable means exist for providing adjustable length hanger bars 305. For example, in certain alternative exemplary embodiments, one or more of the hanger bars described in U.S. Pat. No. 6,105,918, entitled "Single Piece Adjustable Hanger Bar for Lighting Fixtures," the complete disclosure of which is hereby fully incorporated herein by reference, may be utilized in the light fixture housing 100 of FIG. 1.

Each hanger bar 305 is releasably coupled to the plaster frame 102 of the light fixture housing 100. The plaster frame 102 extends between the hanger bars 305 and includes a generally flat plate 102*a* with upturned edges 102*b*. In certain exemplary embodiments, the plaster frame 102 can take the form of several shapes including, but not limited to the shapes of a parallelogram, square, rectangle or other geometric shapes known to those of ordinary skill in the art. In one exemplary embodiment, the plaster frame 102 has a rectangular shape. The plaster frame 102 is typically made of a metallic material, for example steel, and the material used to manufacture the plaster frame 102 can be selected for its ability to wick thermal energy from the can 104 and the lamp assembly 108. The flat plate 102*a* of the plaster frame 102 can rest on a top surface 210 of the ceiling or be positioned adjacent to and substantially parallel with the top surface 210 of the ceiling. A junction box 310 is mounted to the top surface of the flat plate 102*a*. In certain exemplary embodiments, the junction box 310 is a box having insulated wiring terminals and knock-outs for connecting external wiring (not shown) to a lamp assembly 108 disposed within the can 104 of the light fixture 100.

The plaster frame 102 includes a generally circular aperture 102*c* sized for receiving the can 104. In certain exemplary embodiments, the aperture 102*c* has a diameter of between three and four inches. The aperture 110*c* provides an illumination pathway for the lamp 115. A person of ordinary skill in the art having the benefit of the present disclosure will recognize that, in certain alternative exemplary embodiments, the aperture 102*c* can have a different, non-circular, shape that corresponds to an outer profile of the can 104.

The can 104 has a generally cylindrical shape and includes a first aperture 104*a* positioned along the top of the can 104 and a second aperture 104*b* positioned along the bottom of the can 104. A channel is provided through the inside of the can 104 connecting the first 104*a* and second 104*b* apertures. The can 104 is slidably engaged to the plaster frame 102 through the circular aperture hOc by positioning at least a portion of the can 104 through the circular aperture 102*c*, as shown in FIG. 2.

A trim assembly 106 is coupled to the can 104. In certain exemplary embodiments, the trim assembly 106 can include fasteners 107 for releasably coupling the trim assembly 106 to the can 104 by slidably inserting the trim assembly 106 through the second aperture 104*b* of the can 104 and hooking or fastening the fasteners 107 to one or more notches (not shown) along the interior surface of the can 104. A person of ordinary skill in the art having the benefit of the present disclosure will recognize that many other suitable means exist for coupling or releasably coupling the trim assembly 106 to the can 104 including, but not limited to, adhesive, screws, and tabs and slots. In certain exemplary embodiments, the trim assembly 106 includes a first annular surface 109 and a second annular surface 111. The first annular surface 109 has an outer diameter substantially equal to the inner diameter of the can 104, such that the first annular surface 109 may slidably engage and be positioned within the can 104. The first annular surface 109 can also have a substantially cylindrical shape and connected openings along the top and bottom of the first annular surface defining a passage therethrough. In these exemplary embodiments, the fasteners 107 are coupled along the interior or exterior surface of the first annular surface 109.

In certain exemplary embodiments, the second annular surface 111 has an internal diameter substantially equal to the internal diameter of the first annular surface 109 and an outer diameter greater than the outer diameter of the first annular surface 109. In certain exemplary embodiments, as shown in FIG. 2, when assembled, the top side of the second annular surface 111 is positioned adjacent the bottom side of the can 104. In certain exemplary embodiments, the trim assembly 106 is constructed of die cast aluminum.

The exemplary light housing 100 also includes a lamp assembly 108 disposed within and coupled to the trim assembly 106 and positioned within the can 104 as shown in FIG. 2. The lamp assembly 108 includes an electrical connection (not shown) to the junction box 310 for providing electrical power to the lamp assembly 108. The lamp assembly 108 also includes a lamp 115 for illuminating a portion of the area below the light housing 100. In certain exemplary embodiments the lamp 115 is a fifty watt lamp. In these exemplary embodiments, the lamp 115 can be more specifically described as a fifty watt MR16 lamp.

The exemplary light housing 100 further includes a gasket 110 having a substantially annular shape. The gasket 110 is typically disposed between the top side of the second annular surface 111 and the bottom side of the can 104. The gasket 110 can be configured to provide additional air tightness and prevent light-loss between the trim assembly 106 and the can 104. In certain alternative exemplary embodiments, the gasket 110 can be omitted. In such embodiments, the form-fitting relationship between the top side of the second annular surface 111 and the bottom side of the can 104 limits thermal and light loss between the can 104 and the trim assembly 106.

The exemplary light housing 100 also includes an outer housing 112 releasably coupled to the plaster frame 102. A person of ordinary skill in the art having the benefit of the present disclosure will recognize that many suitable means exist for coupling the outer housing 112 to the plaster frame 102 including, but not limited to, placing tabs 113 positioned along the bottom side of the outer housing 112 through slots (not shown) in the plaster frame 102. The outer housing 112 includes four vertical panels 112*a*, 112*b*, 112*c*, and 112*d* and a top panel 112*e*. Each of the four vertical panels 112*a*, 112*b*, 112*c*, and 112*d* is coupled along its respective top edge to an edge of the top panel 112*e*. In certain exemplary embodiments, vertical panels 112*a* and 112*c* are parallel to one another and vertical panels 112*b* and 112*d* are parallel to one another. In an alternative embodiment, the four vertical panels 112*a*, 112*b*, 112*c*, and 112*d*, and the top panel 112*e* can be an integral housing stamped or formed from a single piece of material. In certain exemplary embodiments, the outer housing 112 is made from a metallic material, such as aluminum. More specifically, the outer housing 112 can be made from 3004 aluminum.

In certain exemplary embodiments, one of the vertical panels 112*a* can include an aperture 114. In these exemplary embodiments, the aperture 114 is generally shaped to substantially match the shape of the junction box 310 and is positioned adjacent to the junction box 310, such that the junction box 310 abuts against the aperture 114 and limits heat dissipation through the aperture 114. In certain exemplary embodiments, the outer housing 112 has a width substantially equal to nine inches, a height substantially equal to seven inches, and a depth substantially equal to eleven inches. In certain alternative embodiments, the outer housing 112 has a width substantially equal to twelve inches, a height substantially equal to five and one-quarter inches and a depth substantially equal to thirteen inches. In certain other alternative embodiments, the outer housing 112 has a volume of less than nine hundred cubic inches. A person of ordinary skill in the art having the benefit of the present disclosure will recognize that the outer housing 112 can alternatively be designed in several different shapes other than the box-shape as described herein to suit the intended purpose and specific geometries of the particular installation site.

The exemplary light housing 100 also includes a doubler panel 116. In certain exemplary embodiments, the doubler panel 116 is a flat or substantially flat plate with downturned or upturned (not shown) edges. In certain exemplary embodiments, the doubler panel 116 can take the form of several alternative shapes and will typically have a planar geometry that matches the horizontal planar geometry of the outer housing 112. In one exemplary embodiment, the doubler panel 116 has a rectangular shape and dimensions that are substantially equal to the internal dimensions of the horizontal cross-section of the outer housing 112. The doubler panel 116 is typically made of a metallic material, such as aluminum. More specifically in certain exemplary embodiments, the doubler panel 116 is made of 3004 aluminum.

The doubler panel 116 is slidably coupled to the interior of the outer housing 112. A person of ordinary skill in the art having the benefit of the present disclosure will recognize that many suitable means exist for coupling or releasably coupling the doubler panel 116 to the outer housing 112 including, but not limited to, adhesives, screws, rivets, and the like. The doubler panel 116 can also include one or more tabs 118 positioned along the periphery of the doubler panel 116 and extending above the flat plate of the doubler panel 116. As shown in FIG. 2, the tabs 118 can contact the bottom surface of the top panel 112*e* and define the separation between the flat plate of the doubler panel 116 and the top panel 112*e*.

The exemplary doubler panel 116 also includes a generally circular aperture 120 positioned on the substantially flat plate of the doubler panel 116. In certain exemplary embodiments, the aperture 120 in the doubler panel 116 is offset from the aperture 102*c* in the plaster frame 102. The aperture 120 is typically smaller than the aperture 102*c* in the plaster frame 102. The aperture 120 provides access to a thermal sensor (not shown) coupled to the bottom side of the top panel 112*e* inside the outer housing 112. The thermal sensor is electrically coupled in series with and between the electrical supply in the junction box 310 and the lamp assembly 108. The aperture 120 also typically has an access panel 117 that covers the aperture 120 when access to the thermal sensor is not occurring. The access panel 117 can slide, rotate, flip or otherwise can be easily adjustable from an open to a closed position over the aperture 120.

If the thermal sensor senses a temperature that is above an allowable level, either through misuse or improper installation of the housing 100 or because a lamp 115 having a wattage that is above the rated wattage for the housing 100, the sensor will prevent the power supply from reaching the lamp assembly 108. In certain exemplary embodiments, the allowable temperature level is ninety degrees Celsius. Furthermore, in certain exemplary embodiments the rated wattage for the housing 100 is fifty watts.

In certain exemplary embodiments, when assembled, the light fixture housing 100 provides improved thermal conductivity over prior IC housings and allows for the use of a fifty watt lamp 115 with an outer housing 112 having a much smaller surface area for heat dispersion purposes. When power is supplied and the lamp 115 is activated, the lamp 115 emits infrared light though the first aperture 104*a* and the second aperture 104*b* of the can 104. The exemplary aluminum can 104 being open on both ends creates a boundary around the lamp 115, draws the thermal energy away from the lamp 115, and drives the thermal energy from the lamp 115 up into the outer housing 112 and away from the ceiling surface 210. The thermal energy then contacts the doubler panel 116, which improves the ability of the panels 112*a*, 112*b*, 112*c*, 112*d*, and 112*e* to conduct heat. Without the doubler panel 116, the thermal energy would go directly towards the top panel 112*e* (which is an exterior surface) due to radiation and convection caused by the open can 104 and the thermal temperatures for a fifty watt lamp at the top panel 112*e* would exceed the allowable maximum.

Thermal testing is typically conducted on recessed IC housing light fixtures to determine the temperature levels of the exterior of the fixture 100. If the surface of the fixture 100 exceeds ninety degrees Celsius during operation the fixture 100 is considered to be outsider the permitted range. The temperature requirements are designed to prevent the fixture 100 from starting a fire at the point where the trim 106 contacts the ceiling 205, where the plaster frame contacts the ceiling 210 or where the remaining portions of the fixture 100 (including the outer housing 112) contact the insulation or joists.

During recessed thermal testing, multiple temperature sensors are applied to the fixture 100 and power is supplied to the lamp 115 for a time interval of at least seven and one-half hours. At the end of the time interval, the maximum temperature reading at each sensor is determined. If any sensor along an exterior surface has a reading that is greater than ninety degrees Celsius, the fixture 100 fails the test. Multiple recessed thermal tests have been conducted to determine the thermal performance characteristics of certain exemplary light fixture housings 100 having the mechanical and structural features described above. The testing was completed on the light fixture housing 100 with several different trim types, each having different mechanical designs and different thermal characteristics.

The following table summarizes the recessed thermal testing results of certain exemplary light fixture housings having mechanical structures substantially similar to the light fixture housing 100 with a second aperture 104*b* in the can 104 that is three inches in diameter:

IC Light Fixture Housing 100; Recessed Thermal Testing Results

| Trim Style | Lamp angle (degrees off down angle) | Wattage (W) | Can side bottom (° C.) | Plaster ground at wood (° C.) | Trim in contact with wood (° C.) | Can top center (° C.) | Thermal protector (° C.) |
|---|---|---|---|---|---|---|---|
| 3001 | 0 | 50 | 78 | 83 | 85 | 83 | 87 |
| 3001 | 15 | 50 | 79 | 86 | 88 | 84 | 88 |
| 3002 | 15 | 50 | 70 | 68 | 73 | 74 | 79 |
| 3002 | 0 | 50 | 69 | 62 | 70 | 74 | 78 |
| 3003 | 0 | 50 | 68 | 67 | 73 | 72 | 78 |
| 3003 | 35 | 50 | 72 | 72 | 79 | 76 | 80 |
| 3004 | 35 | 50 | 67 | 61 | 68 | 71 | 76 |
| 3004 | 0 | 50 | 66 | 59 | 65 | 70 | 75 |
| 3005 | 0 | 50 | 62 | 60 | 62 | 66 | 70 |
| 3006 | 0 | 50 | 74 | 79 | 84 | 80 | 86 |
| 3006 | 25 | 50 | 76 | 80 | 86 | 81 | 87 |
| 3007 | 0 | 50 | 73 | 54 | 61 | 79 | 84 |
| 3008 | 0 | 50 | 72 | 51 | 66 | 78 | 83 |
| 3009 | 45 | 50 | 58 | 56 | 60 | 60 | 63 |
| 3009 | 0 | 50 | 59 | 55 | 59 | 62 | 65 |

As illustrated in the above table, the exemplary light fixture housing 100 successfully maintained an exterior temperature below ninety degrees Celsius when using a fifty watt lamp regardless of the type of trim assembly 106 used with the fixture 100 or the angle of disposition of the lamp 115 during the testing period. The results above for the light fixture housing 100 were unexpected. Typically, the light fixture housing 100 would need an outer housing 112 having a much larger surface area and internal volume thirty percent larger in order to dissipate the thermal energy sufficiently over the exterior of the fixture 100 without the exterior of the fixture 100 reaching a temperature over ninety degrees Celsius.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art without departing from the spirit and scope of the present invention defined in the following claims, the scope of which is to be accorded the broadest interpretation so as to encompass such modifications and equivalent structures.

We claim:

1. A recessed light fixture comprising:

a first plate comprising a first aperture;

a can light positioned within the first aperture, wherein the can light comprises:

a can comprising;

a first unobstructed opening along an upper portion of the can; and a second opening along a bottom portion of the can, the openings defining an axial channel through the can; and a lamp positioned within the channel of the can adjacent to the second opening;

a housing positioned about at least a portion of the can, wherein the housing comprises:

a plurality of wall members;

a ceiling member; and a second plate positioned between the first plate and the ceiling member within the plurality of wall members, the second plate comprising a second aperture disposed along an interior of the second plate.

2. The recessed light fixture of claim 1, wherein the housing is coupled to the first plate and the wall members extend in an upward direction from the first plate.

3. The recessed light fixture of claim 1, wherein the second opening is a circular opening.

4. The recessed light fixture of claim 1, wherein the second plate and the ceiling member are in a spaced-apart orientation wherein an air gap is located between the second plate and the ceiling member.

5. The recessed light fixture of claim 4, wherein the ceiling member is substantially parallel to the second plate.

6. The recessed light fixture of claim 1, wherein the second plate is coupled to at least one of the plurality of walls and wherein the second plate further comprises:

at least one protrusion extending vertically from the second plate, wherein the top of the protrusion is in contact with the ceiling member.

7. The recessed light fixture of claim 1, further comprising a thermal sensor positioned between the second plate and the ceiling member, wherein the thermal sensor is electrically coupled to the lamp and deactivates the lamp if a predetermined temperature is sensed by the thermal sensor.

8. The recessed light fixture of claim 1, further comprising:

a trim assembly slidably positioned through the second opening of the can and comprising:

a first section having at least a portion positioned within the can; and a second section positioned adjacent a bottom lip of the can, wherein the second section has a greater outside dimension than the first annular section; and a gasket disposed between the second section and the bottom lip of the can.

9. The fixture of claim 1, wherein the second aperture is axially offset from the first aperture.

10. The fixture of claim 9, wherein the second aperture is smaller than the first aperture.

11. The fixture of claim 1, wherein the second plate further comprises an access panel operable to cover the second aperture and adjustable from an open position to a closed position.

12. The fixture of claim 11, wherein the access panel is slidably adjustable.

13. The fixture of claim 11, wherein the access panel is rotatably adjustable.

14. The fixture of claim 11, wherein the access panel comprises a third plate.

15. A recessed light fixture comprising:

a first substantially horizontal panel comprising an aperture vertically through a portion of the first panel;

an open-ended can comprising;

an unobstructed top aperture;

a bottom aperture;

an outer wall; and a hollow inner core connecting the top and bottom apertures and defining an axial channel through the can; wherein at least a portion of the can is sized to fit through the aperture of the horizontal panel;

a lamp assembly comprising a lamp positioned within the channel and adjacent to the bottom aperture of the can and capable of illuminating an area proximate to the fixture;

a housing coupled to the first panel, the housing comprising;

a plurality of wall panels extending vertically away from the first panel;

a second substantially horizontal panel coupled to each of the wall panels along an upper portion of each of the wall panels; and a heat deflection panel positioned within the housing, above the unobstructed top aperture of the can, between the first panel and the second panel, and in a spaced-apart orientation with the second panel; wherein the heat deflection panel comprises a plurality of protrusions disposed along a perimeter of the heat deflection panel, each protrusion comprising a top end, wherein the protrusion extends vertically upward from the heat deflection panel and contacts a bottom surface of the second substantially horizontal panel.

16. The recessed light fixture of claim 15, wherein the housing has a volume of less than nine hundred cubic inches.

17. The recessed light fixture of claim 15, further comprising a trim assembly positioned adjacent a bottom lip of the can.

18. A recessed light fixture comprising:

a first substantially horizontal panel comprising an aperture extending vertically through a portion of the aperture;

an open-ended cylindrically-shaped can coupled to the first panel and positioned through the aperture of the first panel, wherein a first portion of the can extends above the first panel and a second portion of the can extends below the first panel, the can comprising:

an unobstructed top aperture;

a bottom aperture having a diameter substantially equal to three inches;

an outer wall; and a hollow inner core connecting the top and bottom apertures and defining an open channel vertically through the can;

a lamp assembly positioned within the channel of the can adjacent to the bottom aperture, wherein the lamp assembly comprises a fifty watt lamp;

a housing coupled to the first panel and positioned about the first portion of the can, the housing comprising:

a substantially horizontal ceiling panel; and a plurality of wall panels coupled to the ceiling panel and extending downward from the ceiling panel, wherein a lower portion of each wall panel is adjacent to the first panel;

a heat deflection panel positioned above the first portion of the can within the housing and in a spaced-apart orientation with the ceiling panel, wherein the heat deflection panel is in contact with each of the wall panels;

a trim assembly coupled to the second portion of the can and having a portion of the trim assembly positioned adjacent to a bottom lip of the can; and a gasket disposed between the trim assembly and the bottom lip of the can.

19. The recessed light fixture of claim 18, wherein the housing has a volume of less than or equal to nine hundred cubic inches.

20. A recessed light fixture comprising:

a first plate comprising a first aperture;

a can light positioned within the first aperture, wherein the can light comprises:

a can comprising:

a first unobstructed opening along an upper portion of the can; and a second opening along a bottom portion of the can, the openings defining an axial channel through the can; and a lamp positioned within the channel of the can adjacent to the second opening;

a housing positioned about at least a portion of the can, wherein the housing comprises:

a plurality of wall members;

a ceiling member; and a second plate positioned between the first plate and the ceiling member within the plurality of wall members the second plate comprising a plurality of protrusions extending vertically upward from the second plate, each protrusion comprising a top portion, the top portion of each protrusion contacting a substantially horizontal surface of the ceiling member.

21. The fixture of claim 20, wherein the protrusions define a vertical separation between the second plate and the ceiling member.

22. The fixture of claim 20, wherein the protrusions are disposed along a periphery of the second plate.

23. A recessed light fixture comprising:

a first plate comprising a first aperture;

a can light positioned within the first aperture, wherein the can light comprises:

a can comprising;

a first unobstructed opening along an upper portion of the can; and a second opening along a bottom portion of the can, the openings defining an axial channel through the can; and a lamp positioned within the channel of the can adjacent to the second opening;

a housing positioned about at least a portion of the can, wherein the housing comprises:

a plurality of wall members;

a ceiling member; and a second plate positioned between the first plate and the ceiling member within the plurality of wall members;

wherein heat generated by the lamp radiates upward through the axial channel, through the first unobstructed opening in the can and directly into the housing.

* * * * *